US005147973A

United States Patent [19]

Ziemba

[11] Patent Number: 5,147,973

[45] Date of Patent: Sep. 15, 1992

[54] MULTI-OPTION FUZE SYSTEM

[75] Inventor: Richard T. Ziemba, Burlington, Vt.

[73] Assignee: The United States of America as represented by the Secretary of the Army, Washington, D.C.

[21] Appl. No.: 805,354

[22] Filed: Dec. 9, 1991

[51] Int. Cl.[5] ..... F42C 13/04

[52] U.S. Cl. ..... 102/214; 102/216; 102/207; 102/265

[58] Field of Search ..... 102/214, 216, 211, 207, 102/522, 523, 520, 212, 213, 265

[56] References Cited

U.S. PATENT DOCUMENTS

| | | | |
|---|---|---|---|
| 3,334,588 | 8/1967 | Larsen | 102/522 |
| 3,871,296 | 3/1975 | Heilprin et al. | 102/211 |
| 3,946,674 | 3/1976 | Pettersson et al. | 102/207 |

OTHER PUBLICATIONS

Industry and Societes, Proximity Fuze, Product Engineering (Nov. 1945), pp. 782–784.

*Primary Examiner*—Stephen M. Johnson

*Attorney, Agent, or Firm*—Anthony T. Lane; Edward Goldberg; Michael C. Sachs

[57] ABSTRACT

A launchable a fin-stabilized round having an HE warhead that is fully telescoped in a cartridge case. The round has a forward, cone-shaped nose section, a base section with a booster cavity and a high-explosive (HE) cavity located therebetween. An HE charge is positioned in the HE cavity and a booster charge is positioned in the booster cavity. A time fuze, mounted in the booster cavity, has a presettable counter that is set by the gunner at firing via a hardwire data link through an electric primer. The tiem fuze will fire the booster charge a predetermined time period after the round is launched to enable a normally disabled proximity fuze that is mounted in the nose section. The proximity fuze will detonate the HE charge upon detection of a proximate target. Also mounted in the nose section is a contact switch for detonating the HE charge upon impact with a hard target.

14 Claims, 2 Drawing Sheets

MULTI-OPTION FUZE SYSTEM

The Government has rights in this invention pursuant to Contract No. DAAA09-76-C-2055 awarded by the Department of the Army.

BACKGROUND OF THE INVENTION

1. Field of the Invention

The present invention relates to the field of ordnance and, more particularly, to a versatile, multi-option fuze system for use with high explosive (HE) warheads.

2. Description of the Prior Art

One of the most critical problems confronting designers of HE ammunition has been the construction of a dependable, versatile multi-option fuze system for use in warheads that are to be fired from ground-based weapons of the type found on many armed combat vehicles such as tanks and the like. Ideally, a versatile fuze system capable of being effectively used on HE warheads should be operative in either a ground-to-air (air burst) mode, a ground-to-ground (air burst) mode or a ground-to-ground (impact) mode. Although there has been a long recognized need for such ammunition, no practical fuze system for performing the above-mentioned functions has yet been devised. The present invention fulfills this need.

SUMMARY OF THE INVENTION

The general purpose of this invention is to provide a multi-option fuze system for use with HE warheads. To attain this, the present invention contemplates a projectile having a unique hardwired digital time fuze functionally combined with a proximity nose fuze in such a manner so as to provide for the selective and effective use of HE warheads in either a ground-to-air (air burst) mode, a ground-to-ground (air burst) mode or a ground-to-ground (impact) mode. More specifically, the present invention includes a launchable fin-stabilized round having an HE warhead that is fully telescoped in a cartridge case. The round has a forward section, a base section with a booster cavity therein and an HE cavity located therebetween. An HE charge is positioned in the HE cavity and a booster charge is positioned in the booster cavity. A time fuze is mounted on the base section to fire the booster charge a predetermined time period after the round is launched. A normally disabled proximity fuze, mounted on the forward section, has an enable circuit for enabling the proximity fuze in response to the firing of the booster charge. A proximity detector detects proximate targets. A detonator, responsive to the proximity detector, detonates the HE charge upon the detection of a proximate target by the proximity detector. A contact switch is mounted on the nose of the proximity switch for energizing the detonator upon impact with a hard target.

It is, therefore, an object of the present invention to provide a projectile with a fuze system capable of selectively providing a proximity air-burst mode when it is desired to use the projectile against air targets.

Another specific object is to provide means for enabling the proximity fuze just as the round approaches the target area to overcome fuze jamming associated with enemy countermeasures.

A further object of the invention is the provision of a variable time-setting feature for air burst of the warhead when firing it in a flat trajectory over the earth for use when engaging "soft" targets such as troops.

Still another object is to provide a point-detonating feature which will function the round when impacting hard targets.

Yet another object of the present invention is the provision of a self-destruct feature in the event the round fails to function in the proximity mode when engaging an air target.

A still further object is to provide selectivity via fuze time-setting information that is inputted to the fuze system through a hardwired link between the round and the weapon while not complicating the "normal" round-weapon interface.

Yet a further specific object of the invention is to assure a safe warhead design which precludes the need for any mechanical or electrical penetrations of an unconventional manner into or through the HE section of the warhead.

A still further object is to allow time setting to easily be accomplished within the cycle rate of the weapon.

Yet another specific object of the invention is the provision of means for performing all fuze time-setting functions while the round is fully chambered and the weapon breech is closed.

Still another object of the invention is to assure bore safety and a reasonable fuze-arming delay.

With these and other objects in view, as will hereinafter more fully appear, and which will be more particularly pointed out in the appended claims, reference is now made to the following description taken in connection with the accompanying drawings.

DETAILED DESCRIPTION OF THE PREFERRED EMBODIMENT

Figure 1:
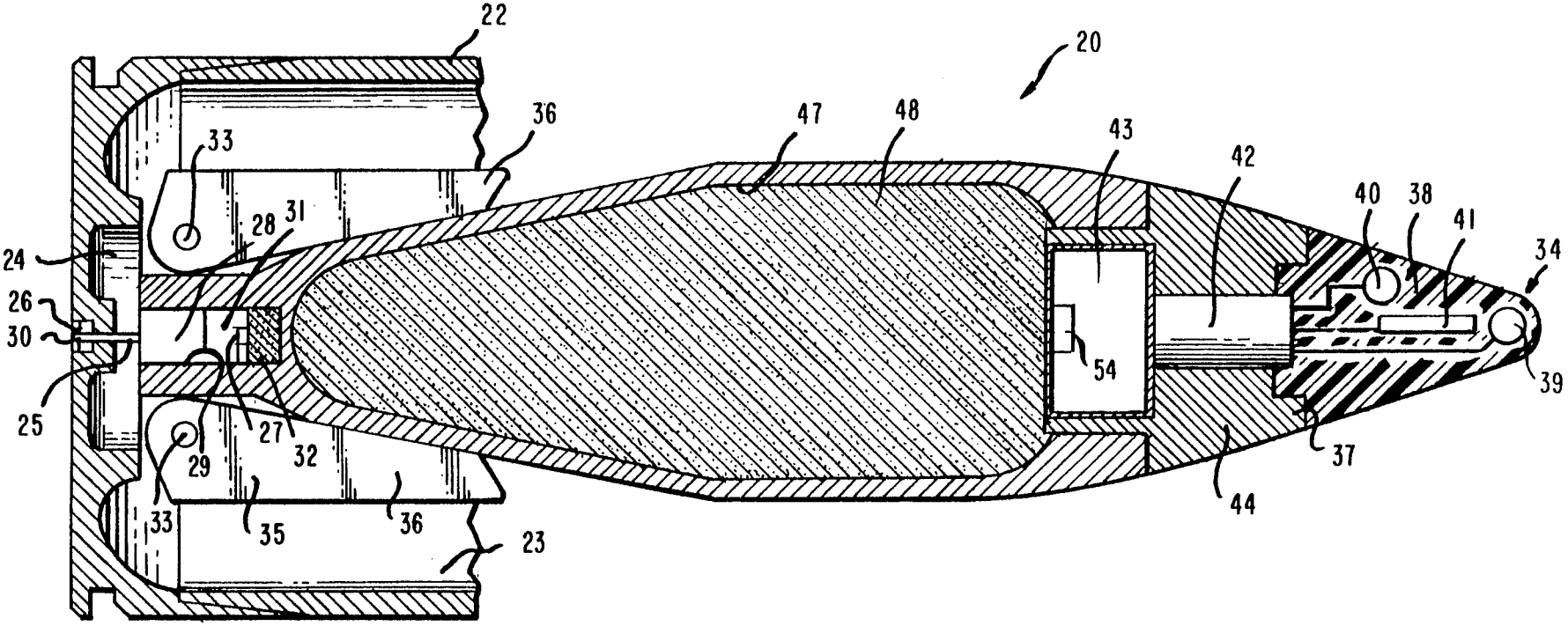
FIG. 1 is a cross-sectional side elevation of a preferred embodiment.

Referring now to the drawings, there is shown in FIG. 1 a projectile 20 comprising a fin-stabilized HE round fully telescoped within a cartridge case 22. The interior of the case 22 includes a propellant chamber 23 in communication with a powder-charge cup 24. An electric primer 25 includes an electrical terminal 30 located in a primer cup 26 at the rear exterior of the case 22. The primer further includes an electrically insulated feed through that passes through the case 22 and extends into electrical contact with a digital time fuze 28 located in a booster cavity 29 at the rear of the projectile 20. The cavity 29 also houses a booster charge 32 and a safing and arming (S&A) mechanism 31 with a squib 27 to fire the booster charge 32. The purpose of the booster charge 32 is to impart a momentary acceleration to the round while not detonating the main charge 48.

A fin assembly 35, mounted at the rear of the projectile 20, has a number of retracted fins 36 that are mounted on pivots 33. After the projectile 20 is fired and it leaves the gun tube, the retracted fins 36 will rotate on the pivots 33 to extend radially into a position that provides aerodynamic stability to the projectile 20.

A base-mounted, time fuze in combination with a fully telescoped round of the type disclosed herein is also described in detail in my copending and commonly assigned U.S. patent application, Ser. No. 07/676,610, filed on Mar. 28, 1991, entitled *Electric Fuze with Selectable Modes*, which application is incorporated herein by reference.

A cavity 47, located in the main body of the projectile 20, holds the main HE charge 48. Directly in front of the chamber 47 is a cone-shaped nose 37 that houses a proximity/contact fuze 34. The forward section 38 houses a high negative-g contact switch 39, a positive-g enable switch 40 and an antenna 41. Switch 39 is designed to close in response to negative reaction forces created when the projectile 20 makes impact with a hard target such as the earth, a bridge, a tank, or like object. The positive-g enable switch 40 is designed to be normally open and to be in a closed position only when the projectile 20 is experiencing a positive-g force of sufficent magnitude.

The rear section 44 of the nose 37 houses a proximity fuze circuit 42 and an S&A 43 that, when activated by circuit 42, causes detonation of the HE charge 48 via a detonator 54. The switches 39, 40 and the antenna 41, electrically connected to the circuit 42, are imbedded in the section 38 which may be made of molded plastic.

Figure 2:
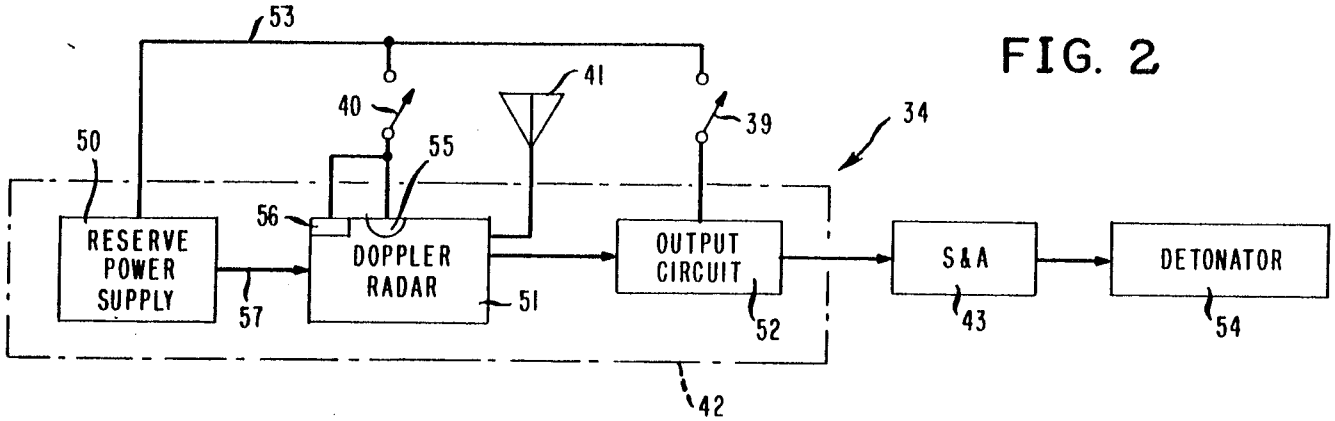
FIG. 2 is a block diagram of a portion of the device shown in FIG. 1.

FIG. 2 shows a functional block diagram of the fuze 34. The fuze circuit 42 includes a reserve power supply 50, a doppler radar 51, having an enable gate 55 and an internal R-C timer 56, and an output circuit 52. The reserve power supply 50 may be a conventional thermal- or liquid-activated device wherein activation would be initiated by accelerations generated when the projectile 20 is fired. The supply 50 will put out a voltage on the line 53 when it is fully activated.

Any momentary closing of the switch 40 after the power supply 50 is fully active will cause the doppler radar 51 to be enabled via enable gate 55. When enabled, the radar 51 will begin transmitting and receiving signals via antenna 41 under the power provided by the supply 50 via line 57. Also, the R-C timer 56 will start charging at this time. It is noted that even though the switch 40 may be momentarily closed during the initial firing of the projectile 20, the radar 51 will not be enabled at this time because the reserve power supply 50 will not yet be fully active. A short time delay, typically about 50 milliseconds, is normally required before full activation of the reserve power supply 50 is acheived.

An output line from the doppler radar 51 is directed to the output circuit 52 which can provide the necessary input signal to the S&A 43 to operate the detonator 54. Operation of the detonator 54 via circuit 52 and S&A 43 is also possible upon closure of the contact switch 39.

Figure 3:
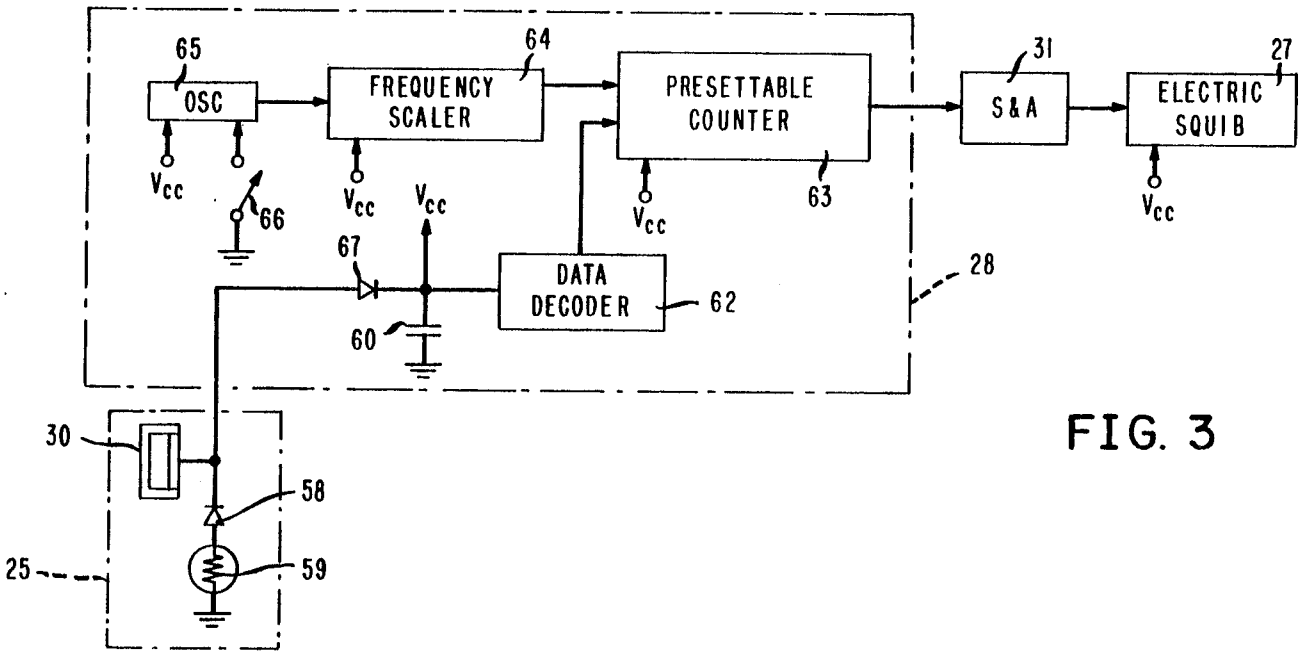
FIG. 3 is a block diagram of another portion of the device shown in FIG. 1.

FIG. 3 shows a functional block diagram of the digital time fuze 28 and its associated circuitry. The electrical input terminal 30 of primer 25 is connected to one side of a grounded igniter 59 via a blocking diode 58. The terminal 30 is further connected to one side of a grounded capacitor 60 and the input of a digital data decoder 62 via a blocking diode 67. The output of the data decoder 62 is connected to one input of a presettable counter 63 which has a second input connected to the output of a frequency scaler 64. The input of the scaler 64 is connected to the output of an oscillator 65. A high positive-g enable switch 66 is connected to the oscillator 65. The output of the counter 63 is connected to the input of the S&A mechanism 31 which, in turn, is outputted to a squib 27 for firing the booster charge 32.

Figure 4:
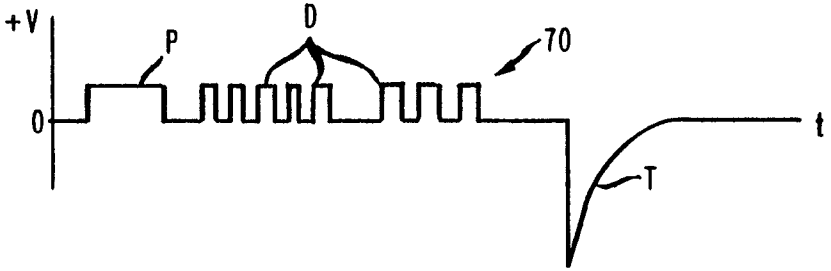
FIG. 4 is a graph of a voltage waveform usefull in understanding the operation of the preferred embodiment.

FIG. 4 shows a typical input pulse train as a voltage vs. time waveform 70 that would be applied by the gunner to the terminal 30 of the primer 25 to fire the projectile 20. The waveform 70 begins with a positive, relatively long (2 millisecond) power pulse P that is followed by a series of short positive data pulses D and is terminated with a negative, relatively large trigger impulse T. The pulse P is long enough to produce a significant charge on the capacitor 60 to produce the voltage Vcc that is used as a source of power to operate the timer circuit components. As seen in FIG. 3, the oscillator 65, scaler 64, counter 63 and squib 64 are all connected to the voltage source Vcc and use it for operational power.

The series of data pulses D are fed to the decoder 62 which will respond by presetting the counter 63 to a predetermined count that is related to an ignition time which in turn is related to a firing range. The negative impulse T represents a typical trigger pulse for firing igniter 59 via the diode 58 of the primer 25. The blocking diode 67 will prevent the impulse T from discharging the capacitor 60 and from reaching the input of the decoder 62. It is noted that the blocking diode 58 blocks the series of positive pulses P, D from reaching the igniter 59 but permits the negative impulse T to fire the igniter 59. When the igniter 59 is fired, the powder in the powder-charge cup 24 will ignite thereby causing the propellant in the propellant chamber 23 to fire the projectile 20 from the gun (not shown).

The high acceleration of the projectile 20 at firing will close the switch 66 causing the oscillator 65 to output a clock signal that is scaled down by the scaler 64 before it is applied to the counter 63 as an input counting signal. The counter 63 will increment its count in response to the counting signal as the projectile 20 is traveling along its flight path to the target. If and when the counter 63 reaches full count from its preset condition as inputted by the gunner (data pulses D) at firing, the counter 63 will output an arming signal to the S&A 31 that will fire the squib 27 to ignite the booster charge 32. It is noted that the switch 66 prevents the oscillator 65 from operating until the projectile 20 is underway down the gun tube. This is a safety feature of the system.

Ignition of the booster charge 32 will produce a rearwardly directed thrust from the booster cavity 29 and, therefore, a forward motion to the projectile 20. This forward motion will cause a sufficent positive acceleration of the projectile 20 to momentarily close the switch 40, thereby enabling the doppler radar 51 via the enable gate 55. The self-destruct timer 56 is also activated at this point. In a typical firing situation, the gunner would program the counter 63 such that the radar 51 is enabled about one-quarter second before arriving at the target range.

With the doppler radar 51 operating, radar signals will be transmitted by the antenna 41. Radar reflections from proximate targets will be received by antenna 41 and fed to radar 51. Radar 51 will now be in a position to detect any frequency-shifted reflections from proximate targets that have a predetermined relative magnitude. If a proximate target is detected, the radar 51 will input the S&A 43 via the output circuit 52. At this point, the detonator 54 will ignite the HE charge 48 and function the projectile 20.

As a self-destruct safety feature, the radar 51, via timer 56, will automatically function the projectile 20 if it has not detected a target within a predetermined time after being enabled. It is also noted that once the reserve power supply 50 is fully active, the projectile 20 will be in a position to function via the switch 39 upon impact with a hard target.

To demonstrate the versatility of the present invention, its operation in a variety of situations will now be described. The projectile 20 may be used in several different roles from a ground position such as from a gun mounted in a mobile, ground combat vehicle. The gunner would condition the projectile 20 to operate in a chosen mode at the time of firing, i.e. when the projectile 20 is in the gun and the breech is locked.

The projectile 20 may be used in an air-defense role by firing it in a ground-to-air (air burst) mode. The gunner would preset the time fuze 28, via data pulses D, to a time setting which will set off the booster charge 32, via S&A 31 and squib 27, just before (one-quarter second) the projectile 20 enters into the target area. The acceleration produced by the initiation of the charge 32 at this time will cause the positive-g switch 40 to momentarily close, thereby enabling the radar 51 at this selected point in the trajectory. Once the projectile 20 closes to within a short distance from the target, the radar 51 will sense the target and detonate the HE charge 48. In the event the projectile 20 does not pass sufficently close to the target to function the fuze circuit 42 in a predetermined time (typically about one-half second), the internal timer 56 will cause the radar 51 to function the detonator 54 and self-destruct the projectile 20 in flight.

When used in an anti-personnel role, the projectile 20 would be fired in a flat trajectory and conditioned to explode in an air burst at the "optimum" standoff for the intended ground target. In this mode, the gunner will preset the time fuze 28 to a setting which would function the charge 32 at the "optimum" standoff for the intended ground target. The resulting acceleration of the projectile 20 due to the time fuze 28 would, at this point, enable the radar 51 and, due to its close proximity to the earth, would immediately function the fuze circuit 42 and hence the HE charge 48 in an "air burst" mode.

The projectile 20 may also be used in an anti-material role. In this role, the projectile 20 is fired in a flat trajectory and is conditioned to fire on impact. The gunner in this case would provide no time data or would preset the fuze 28 to a setting which is beyond the range of the intended target, and then fire the projectile 20 in a low trajectory directly at the target. Since the fuze 28 will not function before reaching the target, the radar 51 will not be enabled. As such, the fuze circuit 42 will function the projectile 20 in response to the closing of the switch 39 when the target is hit.

As can be seen from the various modes of operation just described, the invention has a multi-mission capability. The single projectile 20 may be used in a ground-to-air mode, a ground-to-ground (air burst) mode and a ground-to-ground (impact) mode. The projectile 20 includes a self-destruct feature in the ground-to-air mode. All fuze settings are accomplished an instant before firing directly through the cartridge case 22. No penetrations into the HE cavity 47 from the rear, high-pressure area of the projectile 20 are necessary.

Although a preferred embodiment of the present invention has been shown and described in detail herein, many other varied embodiments that incorporate the teachings of the present invention may be easily constructed by those skilled in the art. It is therefore to be understood, that the foregoing disclosure and drawings are merely illustrative of the principles of this invention and are not to be interperted in a limiting sense. It is to be understood that the invention should not be limited to the exact details of construction shown and described because obvious modifications will occur to a person skilled in the art.

What is claimed is:

1. A launchable projectile containing an HE warhead comprising:

a round having a forward section, a base section with a booster cavity therein and an HE cavity located between said sections;

an HE charge positioned in said HE cavity;

a booster charge positioned in said booster cavity;

a time fuze mounted on said base section having means for firing said booster charge a predetermined time period after said warhead is launched; and a normally disabled proximity fuze mounted on said forward section having enable means for enabling said proximity fuze in response to said firing of said booster charge, a proximity detection means for detecting proximate targets, and a detonator means responsive to said detection means for detonating said HE charge upon the detection of a proximate target by said detection means.

2. The projectile of claim 1 further including a cartridge case and wherein said round is telescoped in said case.

3. The projectile of claim 2 further including a propellant charge positioned in said case and an electric primer means disposed in said case for firing said propellant charge.

4. The projectile of claim 3 wherein said primer means includes an electric circuit means extending from the exterior of said case to said time fuze for inputting time setting information to said time fuze.

5. The projectile of claim 4 wherein said proximity fuze further includes a reserve power supply means for providing power to said proximity fuze responsive to the launch of said warhead.

6. The projectile of claim 5 wherein said proximity detection means is a doppler radar.

7. The projectile of claim 6 further including a contact means responsive to a negative acceleration of said warhead for energizing said detonator means to detonate said HE charge.

8. The projectile of claim 7 wherein said proximity fuze includes a timer means responsive to said firing of said booster charge for energizing said detonator means a predetermined time after said firing of said booster charge.

9. The projectile of claim 8 wherein said time fuze is mounted in s id booster cavity.

10. The projectile of claim 9 wherein said forward section includes a cone-shaped nose.

11. The projectile of claim 10 wherein said enable means includes a positive-g switch means responsive to said firing of said booster charge.

12. The projectile of claim 11 wherein said proximity fuze includes a radar antenna mounted in said cone-shaped nose.

13. The projectile of claim 12 wherein said positive-g switch means and said contact means are mounted in said nose.

14. The projectile of claim 13 wherein said proximity detection means and said detonator means are mounted between said nose and said HE cavity.

* * * * *